United States Patent [19]

Gordon et al.

[11] Patent Number: 4,836,383

[45] Date of Patent: Jun. 6, 1989

[54] MICROWAVE FOOD CARTON WITH DIVIDER PANEL

[75] Inventors: Robert L. Gordon, Monroe; Linda A. Bernstein, Campbell Hall, both of N.Y.

[73] Assignee: International Paper Company, Purchase, N.Y.

[21] Appl. No.: 203,773

[22] Filed: Jun. 7, 1988

[51] Int. Cl.[4] ..... B65D 5/48; B65D 5/54

[52] U.S. Cl. ..... 206/611; 206/45.19; 206/620; 219/10.55 E; 229/120.21; 229/903; 426/107; 426/113; 426/122

[58] Field of Search ..... 206/608, 611, 631, 634, 206/45.19, 620; 229/104, 120.13, 120.18, 120.21, 903; 426/107, 113, 122, 123, 234, 243; 219/10.55 E

[56] References Cited

U.S. PATENT DOCUMENTS

| | | | |
|---|---|---|---|
| Re. 21,592 | 10/1940 | Addis et al. | 229/120.21 |
| 1,352,759 | 9/1920 | Markert | 206/45.19 |
| 2,150,461 | 3/1939 | Sandell | 206/521.6 |
| 2,850,224 | 9/1958 | Meinhardt et al. | 229/120.21 |
| 2,948,455 | 8/1960 | Frankenstein | 229/120.21 |
| 3,004,697 | 10/1961 | Stone | 206/620 |
| 3,078,028 | 5/1945 | Gottlieb | 206/45.19 |
| 3,110,434 | 11/1963 | Linda et al. | 206/611 |
| 3,554,402 | 1/1971 | Lock | 229/52 B |
| 3,735,916 | 5/1973 | Buttery | 206/607 |
| 3,963,167 | 6/1976 | Newgaard, II | 206/425 |
| 4,228,945 | 10/1980 | Wysocki | 426/113 |
| 4,355,757 | 10/1982 | Roccaforte | 229/903 |
| 4,498,420 | 2/1985 | Botterman et al. | 119/15 |
| 4,505,391 | 3/1985 | Kuchenbecker | 229/104 |
| 4,529,089 | 7/1985 | Gasbarra et al. | 426/113 |
| 4,584,202 | 4/1986 | Roccaforte | 206/608 |
| 4,592,914 | 6/1986 | Kuchenbecker | 426/107 |
| 4,594,492 | 6/1986 | Maroszek | 426/113 |
| 4,642,434 | 2/1987 | Cox et al. | 219/10.55 E |
| 4,661,671 | 4/1987 | Maroszek | 219/10.55 E |

FOREIGN PATENT DOCUMENTS

| | | |
|---|---|---|
| 13138 | 10/1901 | Sweden . |

*Primary Examiner*—Gary Elkins

*Attorney, Agent, or Firm*—Walt Thomas Zielinski

[57] ABSTRACT

A food storage carton for the microwave cooking of a foodstuff packaged therein which is to be crispened or browned upon cooking. The carton is fashioned from a one piece blank of paperboard, one panel of which supports a foodstuff, such as a frozen pizza, and which panel is provided with a layer of microwave interactive material which becomes hot upon absorbtion of microwave energy. The construction of the carton is such that the frozen foodstuff is elevated above the carton bottom on a false bottom. Before microwave cooking, the top panel of the carton is ripped off, the carton placed in the oven and the foodstuff cooked.

8 Claims, 3 Drawing Sheets

MICROWAVE FOOD CARTON WITH DIVIDER PANEL

BACKGROUND OF THE INVENTION

This invention relates to microwave cooking of frozen foodstuffs and more particularly to a browning or surface crisping paperboard carton for a frozen pizza or the like.

The introduction of relatively low cost and reliable microwave interactive materials has made microwave cooking more attractive for those foodstuffs which require browning with cooking. Without a microwave interactive material (sometimes referred to as a susceptor material) the cooking of certain frozen foods, such as a frozen pizza, would lack the desired crisping or browning of the bottom of the crust. Consumers desire that a microwave cooked product have the same browned appearance as that of a conventional oven cooked product.

This art is already aware of paperboard cartons, provided with microwave interactive material, for the packaging and microwave cooking of frozen food products. However, such prior constructions usually employ carton geometry which results in a structurally weak carton subject to damage in shipping or storing and the physical manipulation of said carton to position the interactive material for cooking.

SUMMARY OF THE INVENTION

According to the practice of this invention, a microwave ovenable food carton is formed from a unitary blank of paperboard (which may be coated with polymer), with one panel of the blank forming a food supporting false (elevated) bottom. This latter panel is then provided on one or both of its surfaces with a microwave interactive sheet material and carries side flaps which are adhered to the front, rear and side walls. In this manner, the false bottom both elevates the food product to yield an air space below it, and also rigidifies the carton. This composite blank is folded and glued to form a collapsed, open ended tube, suitable for storage and/or shipment to a food packaging installation. There, the collapsed tube is squared up, a frozen food product inserted into one end of the tube, being placed on the false bottom, and both ends of the carton then closed by glueing certain end closure panels or flaps.

In use, the consumer removes the top carton panel and then places the open carton containing a frozen foodstuff in a microwave oven. After oven operation, the food product is both cooked, crisped, and browned. The consumer gains access to the product from the front or from the top of the carton.

DETAILED DESCRIPTION OF THE INVENTION

Figure 1:
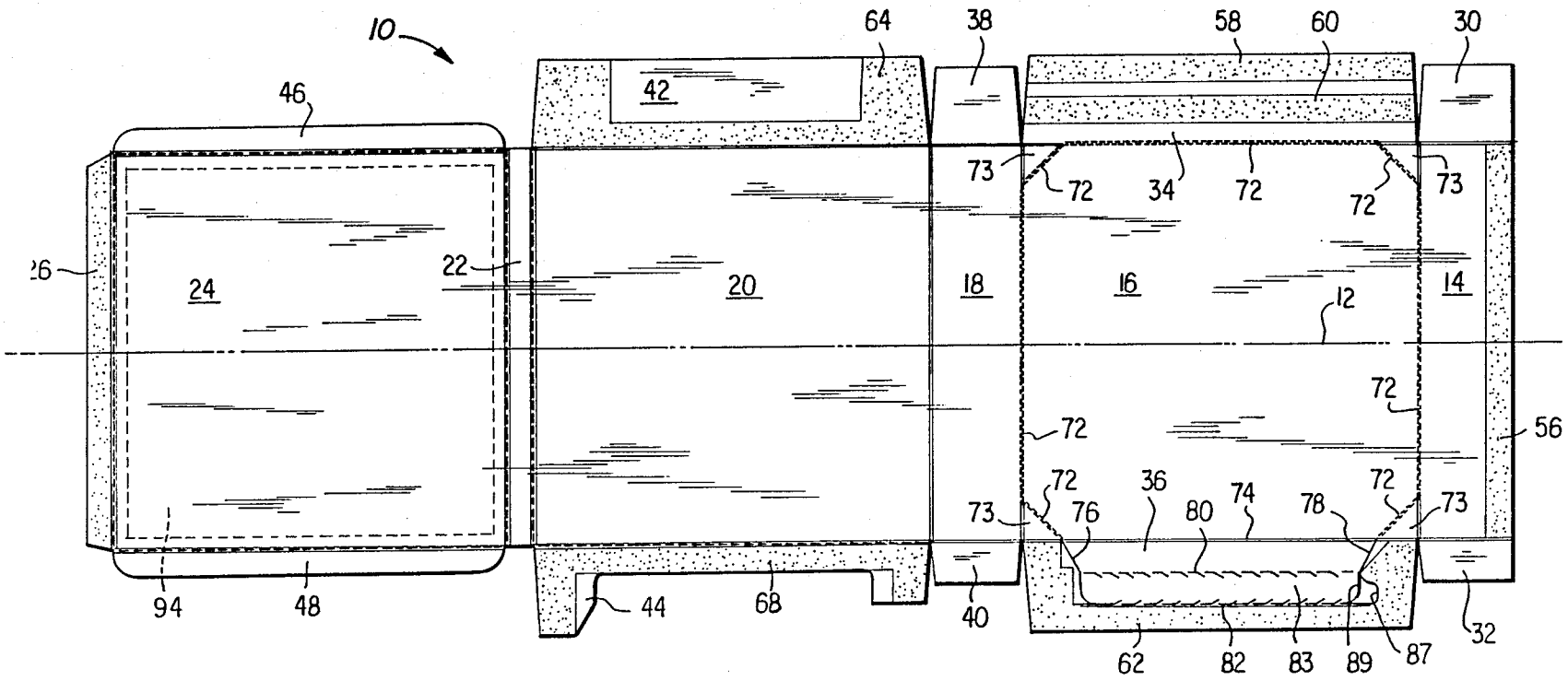
FIG. 1 is a plan view of a unitary blank of paperboard and a microwave interactive sheet from which the carton of the invention is formed by folding and glueing.

Referring now to FIG. 1 of the drawings, the numeral 10 denotes generally a unitary blank of paperboard or other foldable, resilient, stiff and non-electrically conducting sheet material, the blank being in the general form of a rectangle. The numeral 12 denotes a longitudinal, horizontally extending axis of the blank dividing it into upper and lower halves. The blank is provided with score lines to define fold lines or fold axes, and is also provided with cuts and perforations, whose function will shortly be described.

The numeral 14 denotes a first side forming panel foldably joined to a top forming panel 16. The latter is foldably joined to a second side forming panel 18, the latter joined to a bottom forming panel 20. Bottom panel 20 is foldably joined to a food supporting panel support flap 22, the latter joined to a food supporting panel 24. The left edge of the latter is foldably joined to a glue panel 26 which is a supporting flap for the food supporting panel. Each of the panels thus described is serially connected to its neighbor along axis 12. Flaps 26, 46, 48 and panel 14 have free edges, i.e., edges not integrally joined to any other flap or panel. Each of the described panels and flaps is seen also to be generally rectangular in shape, with panels 16, 20, and 24 being essentially square.

The upper edge of panel 14 is foldably joined to a rear closure panel 30, with the lower edge of panel 14 joined to a front closure panel 32. Similarly, top panel 16 is foldably joined to a rear closure panel 34, while the former's lower edge is foldably joined to a front closure panel 36. Second side forming panel 18 is foldably joined at its top edge to rear closure panel 38, while its lower edge is foldably joined to front end closure panel 40. Bottom panel 22 foldably carries at its top edge a rear closure panel 42, and carries at its bottom end a front closure panel 44. The upper and lower edges of panel 22 are free, namely, they are not connected to any other panel. Food supporting panel 24 is provided at its upper edge with a supporting flap 46 and at its lower edge with a similar supporting flap 48. The width of flaps 26, 46, and 48 is the same, as that of flap 26 in a preferred embodiment.

First side panel 14 is provided with a glue zone 56, while numerals 58 and 60 denote glue zones on rear closure panel 34. Similarly, the numeral 62 denotes a glue pattern or zone on front closure panel 36. The numeral 64 denotes a glue pattern or zone on panel 42, with numeral 68 denoting a glue zone on panel 44. All of the glue zones shown are on that surface of the blank facing the reader.

Referring now more particularly to top panel 16, the numeral 72 denotes any of several perforated lines extending around the major portion of its periphery, with the corner perforated lines being biased or slanted at a forty five degree angle to thereby produce web portions 73 at the corners of the top panel after the major or central portion is ripped away, as will later be explained. Numeral 74 denotes a horizontal fold line portion whose ends meet, respectively, the right and left lower ends of the lowermost two of slanted lines 72. The numerals 76 and 78 denote cut lines which extend from the lower ends of these two slanted perforated lines 72 at their respective junctions with fold line 74 to cut lines 76 and 78 which meet the left and right ends of an upper tear strip defining cut line 80 defined by a series of cuts. A lower series of cuts defines a lower tear strip defining line 82, parallel to line 80. A recess in panel 36 is defined by cut 87, with the right end 89 of tear strip 83 bordering this recess.

A microwave interactive material, in the form of a rectangular sheet, is placed (as by an adhesive) on one surface of food supporting panel 24. FIG. 1 shows the outline of this sheet 94 in dashed lines, indicating that it is on that side of panel 24 away from the viewer. It may, however, be placed on that side facing the viewer. If desired, both surfaces of panel 24 may be provided with such a sheet of microwave interactive material.

Figure 2:
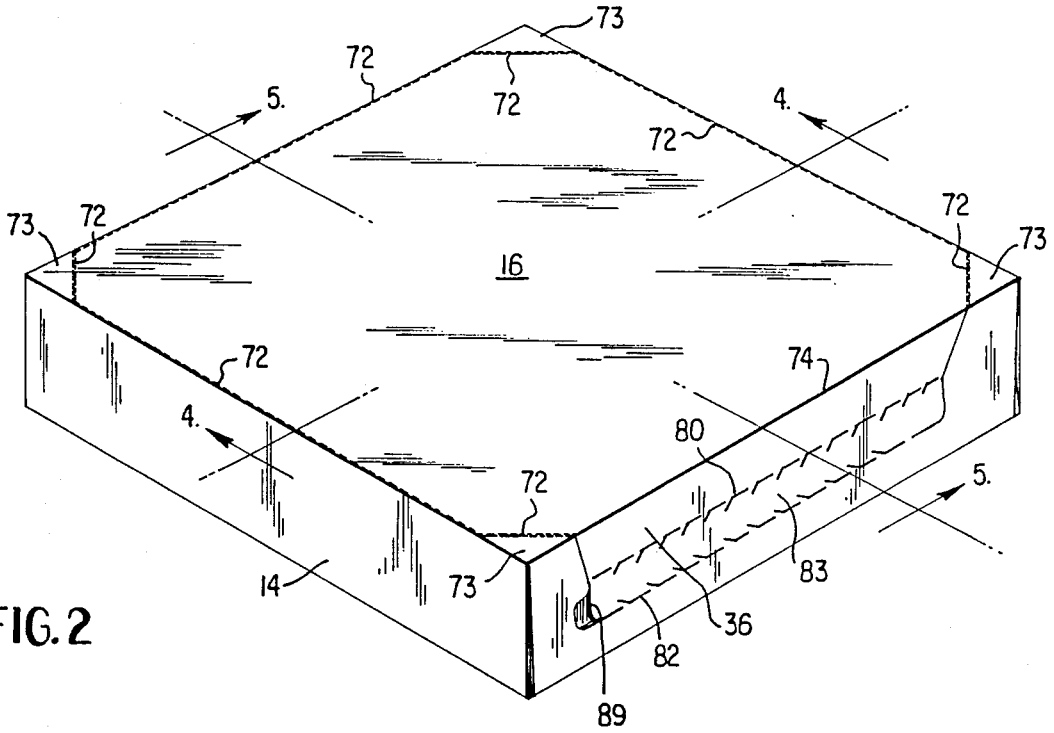
FIG. 2 is a perspective view of the assembled carton containing a frozen foodstuff.

Referring now to FIG. 2 of the drawings, the container has been assembled by first forming it into a tube, this being effected by adhering glue area 56 against the external portion (away from the viewer) of panel 22. Further, glue panel 26 is glued against a portion of second side panel 18, with the free edge of the former directed toward panel 16. This is done in such a manner that panel 24 is parallel to panel 20 upon carton erection.

After thusly forming the blank into a tube, it is collapsed and shipped to a food packager. A frozen food product, such as a pizza, is inserted through the end of the tube and placed on top of the food supporting panel 24. Thereafter, the front and rear ends of the container are closed, this closure being accompanied by the glueing of flaps 46 and 48 on glue zones 64 and 68, respectively. Also, glue zones 58 and 60 of panel 34 are adhered against the outer surface of panel 42. Flaps 32 and 40 are glued to end portions of glue zone 68, while flaps 30 and 38 are secured to the ends of glue zone 64.

Figure 3:
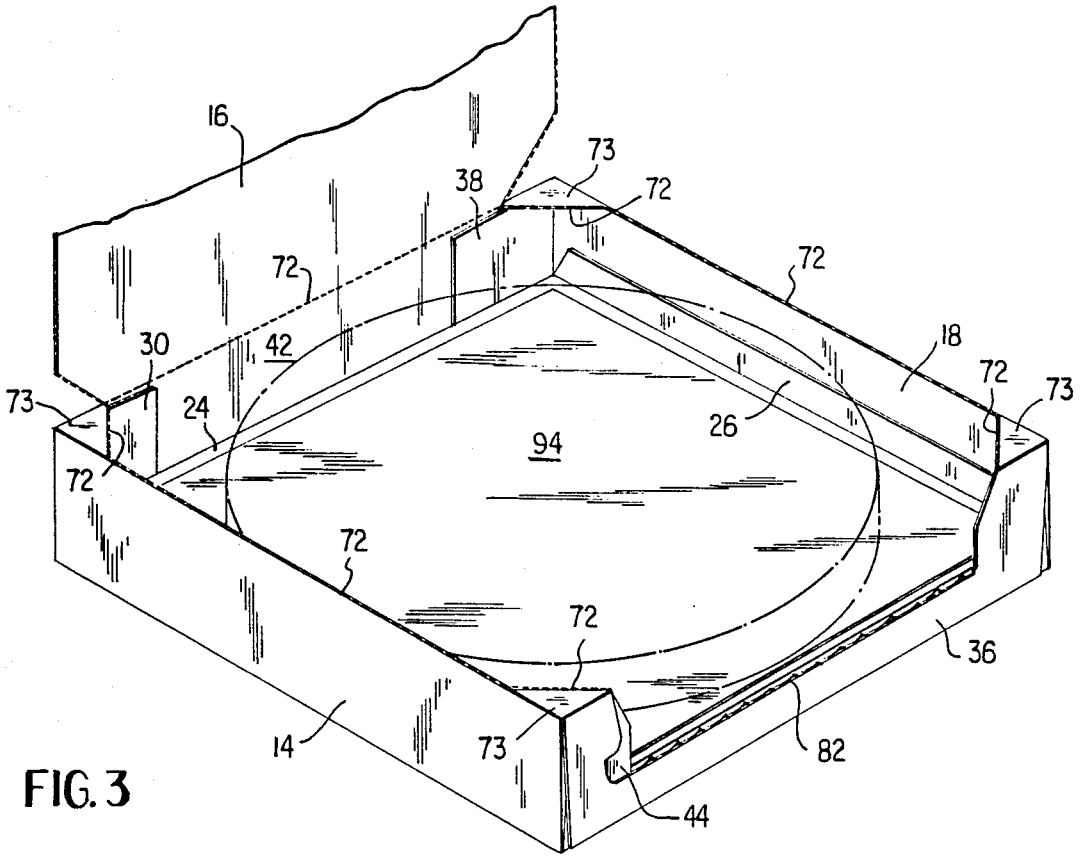
FIG. 3 is a view similar to FIG. 2, showing the carton after it has been opened after cooking.

FIG. 2 illustrates the filled and erected container. In order to use the food package, the consumer rips off the top 16 by grasping end 89 of tear strip 83. This tear strip is pulled and completely removed and discarded. Then, the consumer grasps that tongue like portion of panel 36 above cut line 80 and pulls and rips the major portion of the top panel 16 away and discards it. The consumer now places the package in a conventional microwave oven operating at a frequency of, typically, 2450 Mhz. After a predetermined cooking time (as set forth by the packager of the particular frozen foodstuff involved) the consumer removes the package from the microwave oven. The food product is accessible and the consumer takes the food product and places it on a dish for consumption, for example. Due to the rigidity of panel 24, the food product may be cut while still thereon prior to removal for consumption. These opening steps are readily visualized by reference to FIG. 3, with the cooked pizza indicated by phantom lines.

Figure 4:
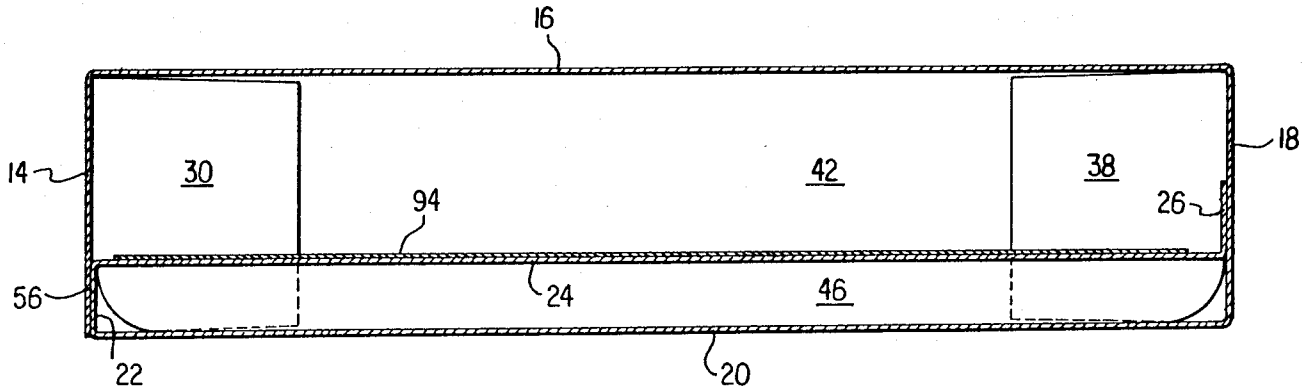
FIG. 4 is a view taken along section 4—4 of FIG. 2.
Figure 5:
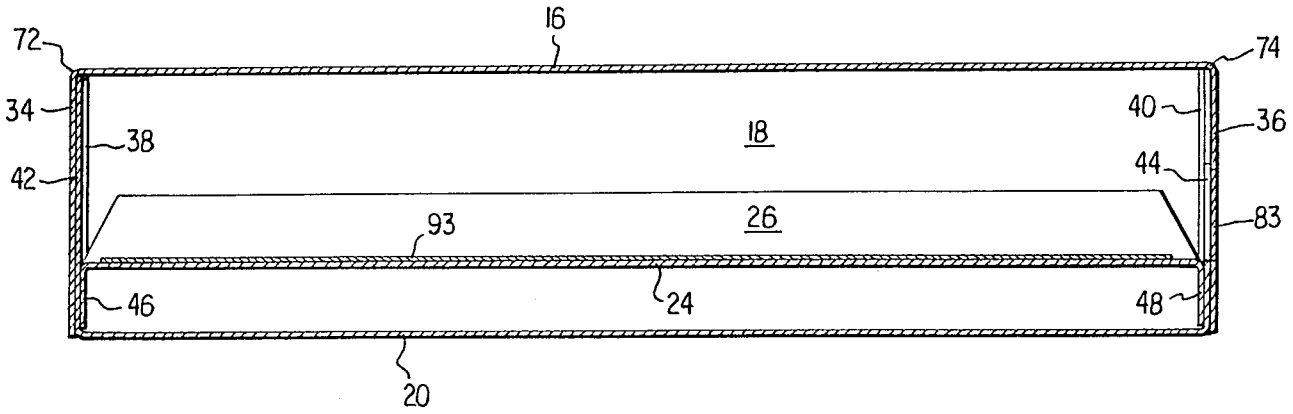
FIG. 5 is a view taken along section 5—5 of FIG. 2.

FIGS. 4 and 5 further illustrate the construction of the carton. It is seen that the free edges of support flaps 26, 46, 48 rest on bottom panel 20. The curved ends of flaps 46 and 48 facilitate assembly, while the free edges of flaps 26, 46, 48 rest on the bottom panel 20 of the carton to increase strength and rigidity and thus resist deformation of the assembled and filled carton during handling. Flaps 30, 32, 38, 40 perform a similar rigidifying function. The opposite directional orientation of flaps 22 (down) and 26 (up) increases ease of collapsing the tube prior to erection and filling with a frozen food product.

The function of microwave interactive sheet 94 is to brown or crispen the contacted surface of the food product. Such sheets or laminates usually include a layer of vacuum deposited aluminum sandwiched between one or more layers of paperboard and plastic. The construction and operation of such microwave interactive materials or laminates is known in this art, as may be seen by reference to U.S. Pat. Nos. 4,230,924 to Brastad et al, 4,267,420 to Brastad, and 4,641,005 to Seiferth.

The terms upper, lower, top and the like in the claims are intended to assist the reader in understanding them and are not intended as terms of limitation.

We claim:

1. A carton formed from a one piece blank of foldable, resilient, flexible and non-electrically conducting sheet material, such as paperboard, the carton being in the form of a rectangular parallelepiped having top, bottom, front, rear, and side panels, the carton also having a food supporting panel which is vertically spaced upwardly from said bottom panel and parallel thereto, said food supporting panel having a sheet of microwave interactive material over at least a portion of its area, the front panel having a tear strip which extends across the major portion of its length, the major portion of the periphery of the top panel provided with joined tear perforation lines, the remainder of said top panel periphery defined by a fold line, said fold line bordering a tongue portion of said front panel which is located above said tear strip, whereby ripping of the tear strip exposes an edge of the tongue portion of the front panel to thus permit the tongue to be grasped and pulled to thereby rip off the major portion of the top panel and gain access to a foodstuff adapted to be placed on the food supporting panel.

2. The carton of claim 1 wherein each edge of said food supporting panel carries a flap, one of said flaps being integrally secured to an edge of said bottom panel, each of said flaps being secured to a respective vertically extending side wall of said carton, to thereby rigidify the food supporting panel and the carton.

3. The carton of claim 2 wherein said flaps on said food supporting panel are of the same width and wherein said food supporting panel is vertically spaced above the bottom panel by an amount equal to said width.

4. The carton of claim 2 wherein said front panel tear strip is defined by a pair of vertically spaced, generally horizontally extending, tear lines and wherein said food supporting panel is at the same vertical height, relative to the bottom panel, as the lowermost one of said front panel, horizontally disposed tear lines.

5. The carton of claim 2 wherein said tear perforations of the major portions of the periphery at the top panel are biased at a 45 degree angle at each of the four corners of the top panel, to thereby define a web between each of the corner upper edges of meeting front, rear and side panels.

6. A blank for the manufacture of a microwave ovenable carton, the carton adapted to contain a frozen food product which is to be cooked and browned in a microwave oven, the blank including a one piece blank of foldable, resilient, flexible and non-electrically conducting sheet material, such as paperboard, the blank being in the general form of a rectangle and having vertically and horizontally extending fold lines, the blank including a plurality of serially arranged panels, said panels being defined by, along its longitudinal axis, a first side panel, a top panel, a second side panel, a bottom panel, a first food supporting panel flap, a food supporting panel, and a second food supporting flap, said panels and flaps adapted to be folded and glued so as to assume the general form of a tube, said first side panel having a foldable end closure flap at both its upper and lower edges, said top panel having a foldable end closure panel at both of its top and bottom edges, said second side panel having a foldable end closure panel at both its top and bottom edges, said bottom panel having an end closure panel at both its top and bottom edges, said food supporting panel having a support flap at both its top and bottom edges, said top panel having tear perforations along the major portion of its periphery, the remaining portion of said periphery being defined by a portion of a fold line coincident with its juncture with the bottom end closure panel of the top panel, said bottom closure panel of the top panel including a pair of cut lines extending from a respective one of said perforated tear lines to the upper end portion of a tear strip, said tear strip being positioned in said lower end closure panel of said top panel and being defined by a pair of vertically spaced and horizontally extending tear cuts, the horizontal extent of said tear strip being less than the horizontal extent of said lower end closure panel of said top panel.

7. The blank of claim 6 including a sheet of a microwave interactive material on a surface of said food supporting panel.

8. The blank of claim 6 including a glue pattern on said first side panels and on each of the end closure panels of said top and bottom panels.

* * * * *